United States Patent [19]

Calder et al.

[11] Patent Number: 4,819,967

[45] Date of Patent: Apr. 11, 1989

[54] CONDUCTOR TIEBACK CONNECTOR

[75] Inventors: Ian D. Calder; Stephen A. Cromar, both of Aberdeen, Scotland

[73] Assignee: Vetco Gray Inc., Houston, Tex.

[21] Appl. No.: 466,236

[22] Filed: Feb. 14, 1983

[51] Int. Cl.[4] ..... F16L 35/00

[52] U.S. Cl. ..... 285/18; 285/85; 285/143; 285/226; 285/315

[58] Field of Search ..... 285/18, 39, 24, 27, 285/85, 142, 143, 226, DIG. 18, 299, 300, 301, DIG. 7, 315

[56] References Cited

U.S. PATENT DOCUMENTS

| | | | |
|---|---|---|---|
| 2,216,468 | 10/1940 | Farrar | 285/226 X |
| 3,321,217 | 5/1967 | Ahlstone | 285/18 |
| 3,527,481 | 9/1970 | Lewis | 285/226 X |
| 4,408,784 | 10/1983 | Reimert | 285/24 |
| 4,453,745 | 6/1984 | Nelson | 285/18 |

FOREIGN PATENT DOCUMENTS

| | | | |
|---|---|---|---|
| 869453 | 3/1953 | Fed. Rep. of Germany | 285/DIG. 7 |

*Primary Examiner*—Dave W. Arola

*Attorney, Agent, or Firm*—Edward L. Kochey, Jr.; James E. Bradley

[57] ABSTRACT

A connector for tying back a wellhead (10) to a floating platform rigidly attaches to the wellhead housing (12). It is engaged with the casing hanger (14) through a bellows (86) arrangement. Strain cycling of the connection is reduced while thermal expansion and manufacturing tolerance are readily tolerated.

12 Claims, 2 Drawing Sheets

CONDUCTOR TIEBACK CONNECTOR

BACKGROUND OF THE INVENTION

The invention relates to subsea oil production systems and in particular to a connector for tying back a riser from a wellhead to a surface platform.

Offshore oil wells may be drilled from a floating platform and thereafter produced to a later constructed fixed or tethered platform. Such a procedure requires the running of tiebacks or risers from the platform deck to the wellhead in order to tieback the wellhead to the platform. Tubing is thereafter run, surface production trees installed, and the wells produced in a conventional manner.

The outermost conductor or riser must be connected and sealed in some manner to the wellhead. Particularly with the tensioned leg platform where the upper end of the riser is permitted to move horizontally, a bending moment is produced at the wellhead. This may occur even with the fixed platform where there is significant current force acting on the riser. The connection to the wellhead must also be capable of carrying substantial vertical force either in compression where insufficient load is carried by the platform or in tension where excessive load is carried by the platform.

Thermal expansion of various components of this structure also occurs depending on whether or not the well is producing at a particular time and the temperature of the fluid being produced. Furthermore as contrasted to the relatively short time period of drilling a well, the riser and its connection must endure these stresses through many cycles over many years.

One approach to making this tieback connection is illustrated in U.S. Pat. No. 4,343,495 wherein the riser funnel is locked to the wellhead housing and seals at the upper end of the housing. This has a single seal location and while the structure can be made very rigid, there can still be slight movements at the seal location which over a period of years would lead to seal failure. Furthermore, the casing hanger packoff is exposed to the fluid and pressure within the inner downhole casing string thereby resulting in possible deterioration of the casing hanger packing.

In another approach to a tieback connection, illustrated in co-pending application Ser. No. 241,187, now U.S. Pat. No. 4,408,784 issued Oct. 11, 1983, the downwardly-extending funnel surrounds the wellhead housing for purposes of limiting deflection while a floating bushing ties the stab pin to the casing hanger. This again has a single seal location which must accept the repeated bending strain up to the limit provided by the housing-funnel interaction. This connection with the bushing and seal ring is also subject to the entire range of tensile and compressive loads placed on the connector. Any vertical upward loading passing through the riser and bushing to the casing hanger is additive with any expansion forces tending to push the hanger up thereby increasing the difficulty of retaining the hanger at its packed off location with the wellhead housing.

In each of the prior art schemes, the seal location is immediately adjacent the direct load path for both bending and tension; and any attempt to provide a secondary seal is plagued with problems because of fabrication tolerance and movement of the various members.

SUMMARY OF THE INVENTION

The wellhead which is to be tied back to the platform has a wellhead housing with external grooves and has a casing hanger set within the housing. This casing hanger carries the inner string of casing and is packed off or sealed to the wellhead housing.

A downwardly-extending funnel is secured to the bottom of the riser with locking means on the funnel adapted to mate with and lock in the external grooves of the wellhead housing. An internal hollow cylindrical stab pin is secured and sealed inside the funnel and extends downwardly. It has an inwardly-extending, upwardly-facing shoulder near the lower end. A seal ring is carried on this stab pin and is adapted to seal with the casing hanger.

An internal floating bushing or torque sleeve has a downwardly-facing shoulder engageable with the shoulder on the stab pin and has threads engageable with threads in the casing hanger. This bushing may be rotated in engagement with the casing hanger to draw the stab pin down into sealing contact with the casing hanger. The stab pin has bellows at the upper end which permit movement of the lower end of the stab pin relative to the funnel throughout a small but reasonable distance at very low stresses.

The bellows has separated structural backup rings so that they maintain substantial longitudinal flexibility while still being able to contain substantial pressure.

The funnel also carries a seal engageable with a wellhead housing which is energized when the wellhead housing is locked down.

A casing hanger lockdown engages grooves within the wellhead and transmits a downward force against the casing hanger. Differential movement, caused by thermal expansion, between the two seal locations is thereby avoided. This also avoids placing the strain caused by the expansion on the bellows.

Accordingly, a tight, rigid structural connection is made between the funnel and the wellhead housing with the secondary seal at that location. The stab pin contains the primary seal with this pin and the seal being isolated from the high forces and strains because of the longitudinal flexibility of the bellows.

DESCRIPTION OF THE PREFERRED EMBODIMENT

Figure 1:
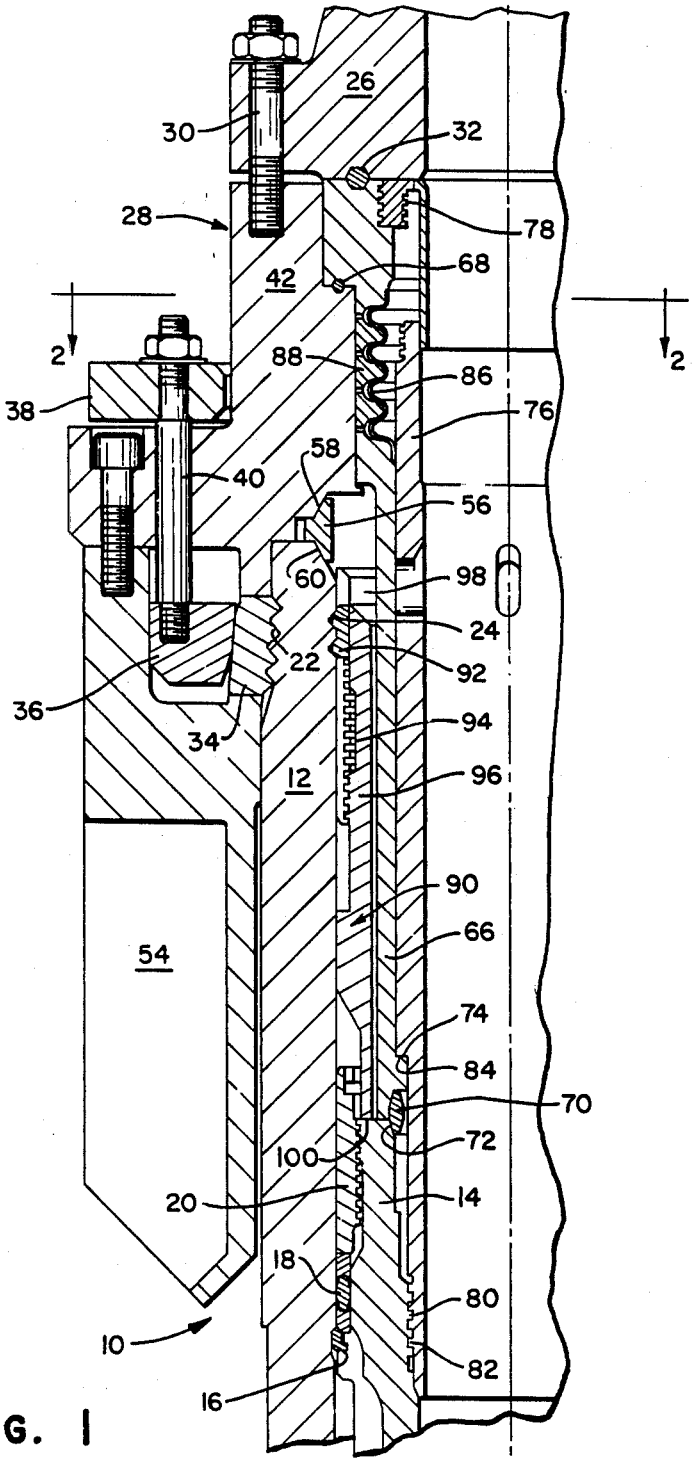
FIG. 1 is a sectional elevation through the connector and wellhead.
Figure 2:
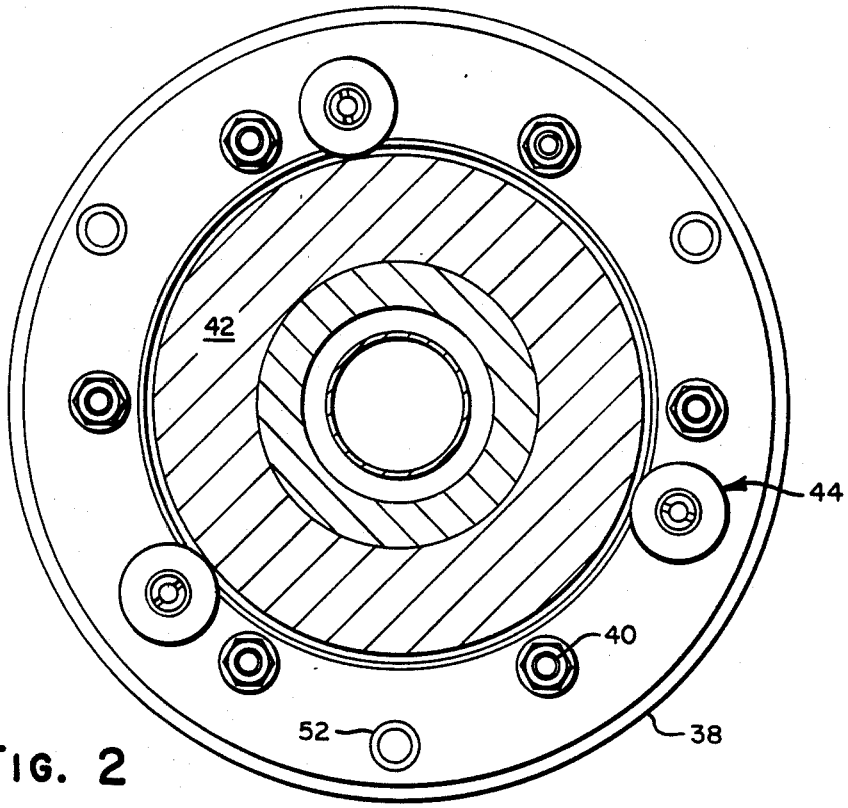
FIG. 2 is a plan view of the connector.

Wellhead 10 includes wellhead housing 12 with casing hanger 14 set therein. This hanger carries the inner string of casing and rests on previously-run casing hangers. Lockdown ring 16 is the conventional lockdown ring suitable for holding the hanger down during drilling operations. The hanger has been packed off by energizing packoff seal 18 by rotation of packing nut 20. The wellhead housing also has circumferential grooves 22 on the outside circumference and grooves 24 on the internal circumference.

Riser 26 is run from a floating platform for the purpose of tying the wellhead back to the platform. Funnel 28 is sealingly secured to the bottom of the riser with bolts 30 and seal 32.

Figure 3:
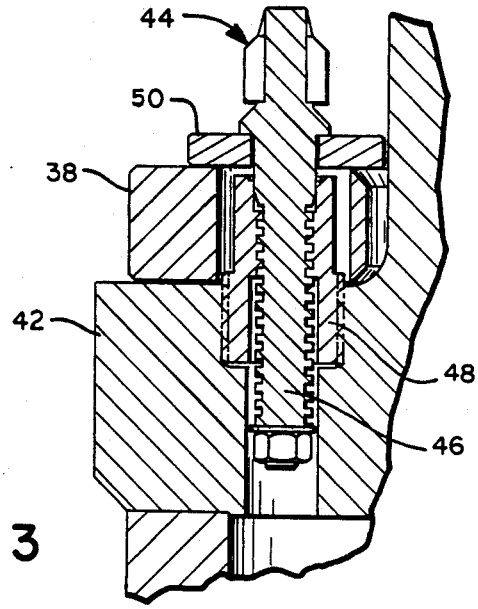
FIG. 3 illustrates the mechanical lock.

This funnel carries locking dogs 34 which are adapted to engage and lock with external grooves 22. Cam ring 36 activates these dogs when it is moved downwardly through the movement of actuation ring 38 operating through connecting rods 40. The cam ring 36 is, therefore, moved vertically with respect to the funnel body 42 to effect horizontal movement and locking of the dogs. A mechanical lock 44 is shown in FIG. 3 with bolt 46 passing through boss 48 which is permanently secured to the funnel body 42. Rotation of the bolt moves washer 50 into contact with the actuation ring 38 after it has been moved downwardly thereby mechanically locking the dog ring behind the dogs so as to preclude inadvertent release. Actuator pins 52 extend upwardly from actuation ring 38 for engagement with hydraulic actuators.

A guide frame, not shown, with hydraulic actuators may be used to operate the various components. This would generally involve a frame run-down on guideline funnels to engage and lock in the template. Hydraulic actuators would then force down actuator pins 52 and separate hyrdaulic actuators would rotate the mechanicl lock 44 to effect mechanical locking of the connector in place.

A guide funnel 54 is secured to the lower end of the funnel to provide protection and to facilitate engagement and alignment of the apparatus when the funnel is being run over the wellhead.

A metallic AX seal ring 56 is secured to the bottom of the funnel during running with a seal surface 58 on the funnel and 60 on the wellhead housing. As the dogs are engaged and forced inwardly, downward movement of the funnel relative to the wellhead energizes seal 56 as well as firmly and securely locking the funnel 28 to the wellhead housing 12.

Stab pin 66 is also sealingly secured to the funnel 28, in the case by being entrapped between the riser and the funnel which is held by bolts 30. Seal 68 seals between the seawater and the outside of the stab pin while seal 32 seals between the seawater and the inside.

The stab pin carries an AX-type metal seal 70 at its lower end adapted for engagement with surface 72 of the casing hanger 14. Stab pin 66 has an inwardly-extending, upwardly-facing shoulder 74 located near the lower end.

A torque sleeve 76 is held in threads 78 while running; and after the dogs have been locked, it is rotated by use of a running tool. It drops free from these threads and engages its lower threads 80 with threads 82 on the casing hanger. This torque sleeve has an outwardly-extending, downwardly-facing shoulder 84 for engagement with the shoulder 74 of the stab pin. Accordingly, rotation of the torque sleeve draws the lower end of the stab pin down energizing seal 70 to effect the primary pressure tight seal. With this seal effected, the casing packoff 18 is protected from prolonged contact with any bore fluid within the casing string.

A longitudinally flexible section in the form of bellows 86 is located between the upper portion where the stab pin 66 is attached to the funnel 28 and the shoulder 84. The bellows is backed up by a plurality of circumferential backup rings 88 each located within an inwardly-extending fold of the bellows. These backup rings are separated, and they facilitate the retention of internal pressure while still permitting longitudinal movement of the stab pin.

This bellows permits the stab pin to elongate as it is pulled in and sealed at the lower end without creating high stresses. It allows for manufacturing tolerance of the components and will accept a reasonable error in the setting height of the casing hanger. Any longitudinal forces or bending forces placed on the connection by the riser are restrained by the high strength connection between the locking dogs 34 and the wellhead housing 12. Any strain occurring because of this bending is not transmitted to the stab pin or its seal because of the ability of the bellows to accept strains in bending and elongation without transmitting high forces. Accordingly, the primary seal 70 is protected from fatigue forces over the production life of the well while a backup seal 56 is also provided between the wellhead housing and the funnel.

Since the connector is secured to both the wellhead housing and the casing hanger, differential movement between the two during operation is of concern. This may occur since the production of a hot fluid may cause the downhole casing to expand thereby tending to lift the casing hanger. Locking rings 16 while satisfactory for lockdown during drilling is not adequate for long-term and possible cycling operation. It inherently has substantial clearance between the lockdown ring and the housing to assure its engagement when setting the hanger. This potential movement can cause fretting and ultimate deterioration of the lockdown ring. Accordingly, with the above-described double connection, it is desirable to have additional lockdown apparatus on the casing hanger.

Accordingly, prior to running the riser, a casing hanger lockdown 90 is run with locking dogs 92 held within recess 94 of the lockdown inner body 96 during running. When the dogs 92 are at the elevation of grooves 24, they are urged outwardly; and the inner body 96 is rotated with respect to the lockdown outer body 98 so that the inner body moves downwardly backing up the dogs 92 and abutting lower surface 100 of the lockdown against the top of the casing hanger. This lockdown thereafter absorbs all expansion forces transmitting the force to the wellhead housing thereby avoiding placing of the cycling strains on the stab pin 66. If expansion moved the casing hanger up sufficiently to close the bellows, it would not adequately perform its task of absorbing strains caused by bending of the riser connection.

We claim:

1. A connector for tying back a production riser from a subsea wellhead to a platform; said wellhead having external grooves and a casing hanger set therein, comprising: a downwardly-extending funnel secured to the bottom of said riser; locking means on said funnel adapted to mate with and lock in the external grooves; an internal hollow cylindrical stab pin sealingly secured internally to said funnel, extending downwardly therefrom, and having an inwardly-extending, upwardly-facing shoulder near the lower end; a seal ring carried on said stab pin and adapted to seal with the casing hanger; an internal torque sleeve having an outwardly-extending, downwardly-facing shoulder, engageable with the shoulder of said stab pin, and having threads engageable with threads in the casing hanger, whereby said torque sleeve may be rotated to draw said stab pin downwardly into sealing engagement with the casing hanger; said stab pin having a longitudinally flexible portion between the upwardly-facing shoulder and the location where it is secured to said funnel.

2. A connector as in claim 1 wherein said longitudinally flexible portion comprises bellows.

3. A connector as in claim 2 having also: separated structural backup rings surrounding each inwardly-extending loop of said bellows.

4. A connector as in claim 1 having also: a wellhead seal carried by said funnel and adapted to sealingly engage with said wellhead, said locking means also energizing said wellhead seal.

5. A connector as in claim 1 having also: means for rigidly locking said casing hanger against upward movement relative to the wellhead housing.

6. A connector as in claim 5 wherein said longitudinally flexible portion comprises bellows.

7. A connector as in claim 6 having also: separated structural backup rings surrounding each inwardly-extending loop of said bellows.

8. A connector as in claim 6 having also: a wellhead seal carried by said funnel and adapted to sealingly engage with said wellhead, said locking means also energizing sail wellhead seal.

9. A conenctor for tying back a production riser from a subsea wellhead to a platform; said wellhead having external grooves and a casing hanger set therein, comprising: a downwardly-extending funnel secured to the bottom of said riser; locking means on said funnel adapted to mate with and lock in the external grooves; an internal hollow cylindrical stab pin sealingly secured internally to said funnel, extending downwardly therefrom, and having an inwardly-extending, upwardly-facing shoulder near the lower end; a seal ring carried on said stab pin and adapted to seal with the casing hanger; an internal torque sleeve having an outwardly-extending, downwardly-facing shoulder, engageable with the shoulder of said stab pin, and having threads engageable with threads in the casing hanger, whereby said torque sleeve may be rotated to draw said stab pin downwardly into sealing engagement with the casing hanger; said stab pin having a longitudinally flexible portion between the upwardly-facing shoulder and the location where it is secured to said funnel; and a casing hanger lockdown comprising; locking dogs engageable with grooves within said wellhead housing, an outer body carrying said dogs, an inner body threadedly engaged with said outer body and having its lower edge formed to abut said casing hanger, said inner body rotatable with respect to said outer body to lock said casing hanger against upward movement with respect to the wellhead housing.

10. A connector as in claim 9 wherein said longitudinally flexible portion comprises bellows.

11. A connector as in claim 10 having also: separated structural backup rings surrounding each inwardly-extending loop of said bellows.

12. A connector as in claim 10 having also: a wellhead seal carried by said funnel and adapted to sealingly engage with said wellhead, said locking means also energizing said wellhead seal.

* * * * *